US011757261B2

(12) United States Patent
Kaji et al.

(10) Patent No.: US 11,757,261 B2
(45) Date of Patent: Sep. 12, 2023

(54) GROUND ELECTRODE FOR SPARK PLUG AND SPARK PLUG

(71) Applicant: DENSO CORPORATION, Kariya (JP)

(72) Inventors: Yuji Kaji, Kariya (JP); Nobuo Abe, Kariya (JP); Naoto Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/980,033

(22) Filed: Nov. 3, 2022

(65) Prior Publication Data

US 2023/0147920 A1 May 11, 2023

(30) Foreign Application Priority Data

Nov. 5, 2021 (JP) ..... 2021-181199

(51) Int. Cl.

| | |
|---|---|
| ***H01T 13/32*** | (2006.01) |
| ***H01T 13/34*** | (2006.01) |
| ***H01T 13/08*** | (2006.01) |
| ***H01T 13/39*** | (2006.01) |

(52) U.S. Cl.
CPC ..... *H01T 13/39* (2013.01); *H01T 13/32* (2013.01)

(58) Field of Classification Search
CPC ..... H01T 13/39; H01T 13/32
See application file for complete search history.

(56) References Cited

U.S. PATENT DOCUMENTS

2010/0275869 A1 11/2010 Musasa et al.
2015/0380907 A1* 12/2015 Kawashima ..... H01T 13/32 313/141
2018/0069378 A1* 3/2018 Shibata ..... H01T 13/16

FOREIGN PATENT DOCUMENTS

CN 101868893 A * 10/2010 ..... H01T 13/39
EP 2270937 B1 * 6/2016 ..... H01T 13/39

OTHER PUBLICATIONS

Nunome et al., CN101868893 , machine translation, 17980033_2023-03-06_CN_101868893_A_H.pdf (Year: 2010).*

* cited by examiner

*Primary Examiner* — Tracie Y Green
(74) *Attorney, Agent, or Firm* — Nixon & Vanderhye P.C.

(57) ABSTRACT

A ground electrode for a spark plug includes a ground electrode body arranged to face a center electrode of the spark plug. The ground electrode includes a discharge portion mounted on the ground electrode body to face the center electrode with a spark gap between the discharge portion and the center electrode. The discharge portion is made of a platinum-based alloy of platinum, rhodium, and nickel. A first mass percent of the rhodium contained in the platinum-based alloy of the platinum, the rhodium, and the nickel is within a first range from 2 wt % to 20 wt % inclusive. A second mass percent of the nickel contained in the platinum-based alloy of the platinum, the rhodium, and the nickel being within a second range from 2.5 wt % to 12 wt % inclusive.

4 Claims, 9 Drawing Sheets

FIG.6

| | COMPOSITION(wt%) | | | HIGH-TEMPERATURE CHARACTERISTICS | | ENGINE DURABILITY CHARACTERISTICS | | |
|---|---|---|---|---|---|---|---|---|
| SAMPLE No. | Pt | Rh | Ni | HIGH-TEMPERATURE STRENGTH EVALUATION INDICATOR (140Mpa以上 ,1000℃) | GRAIN-DIAMETER EVALUATION INDICATOR (100μm以上 ,1100℃-50H) | SWEATING-GRAIN EVALUATION INDICATOR | CRACK EVALUATION INDICATOR | EROSION-RESISTANT INDICATOR |
| 1 | 98 | 2 | 2 | × | ○ | ○ | × | × |
| 2 | 90 | 10 | 2 | × | ○ | ○ | × | × |
| 3 | 80 | 20 | 2 | × | ○ | ○ | × | × |
| 4 | 98 | 0 | 2.5 | ○ | ○ | × | ○ | × |
| 5 | 96 | 2 | 2.5 | ○ | ○ | ○ | ○ | ○ |
| 6 | 78 | 20 | 2.5 | ○ | ○ | ○ | ○ | ○ |
| 7 | 73 | 25 | 2.5 | ○ | × | × | ○ | × |
| 8 | 86 | 10 | 4 | ○ | ○ | ○ | ○ | ○ |
| 9 | 81 | 15 | 4 | ○ | ○ | ○ | ○ | ○ |
| 10 | 93 | 0 | 7 | ○ | ○ | × | ○ | × |
| 11 | 91 | 2 | 7 | ○ | ○ | ○ | ○ | ○ |
| 12 | 73 | 20 | 7 | ○ | ○ | ○ | ○ | ○ |
| 13 | 68 | 25 | 7 | ○ | × | × | ○ | × |
| 14 | 81 | 10 | 9 | ○ | ○ | ○ | ○ | ○ |
| 15 | 76 | 15 | 9 | ○ | ○ | ○ | ○ | ○ |
| 16 | 88 | 0 | 12 | ○ | ○ | × | ○ | × |
| 17 | 86 | 2 | 12 | ○ | ○ | ○ | ○ | ○ |
| 18 | 68 | 20 | 12 | ○ | ○ | ○ | ○ | ○ |
| 19 | 63 | 25 | 12 | ○ | × | × | ○ | × |
| 20 | 84 | 2 | 14 | ○ | ○ | ○ | × (NICKEL OXIDE AT GRAIN BOUNDARY) | × |
| 21 | 71 | 15 | 14 | ○ | ○ | ○ | × (NICKEL OXIDE AT GRAIN BOUNDARY) | × |
| 22 | 71 | 20 | 14 | ○ | ○ | ○ | × (NICKEL OXIDE AT GRAIN BOUNDARY) | × |

GROUND ELECTRODE FOR SPARK PLUG AND SPARK PLUG

CROSS REFERENCE TO RELATED APPLICATIONS

The present application claims the benefit of priority from Japanese Patent Application No. 2021-181199, Nov. 5, 2021, the contents of which are incorporated herein by reference.

TECHNICAL FIELD

The present disclosure relates to ground electrodes for a spark plug, and spark plugs.

BACKGROUND

A ground electrode of a spark plug is comprised of a ground electrode body extending from a metal shell of the spark plug. An extending end of the ground electrode body has a discharge surface that faces one end of a center electrode of the spark plug. The ground electrode is also comprised of a discharge portion mounted on the discharge surface of the extending end of the ground electrode body. The discharge portion provides a predetermined gap between a protrusion end of the discharge portion and the one end of the center electrode.

SUMMARY

A ground electrode for a spark plug includes a discharge portion that is made of a platinum-based alloy of platinum, rhodium, and nickel. A first mass percent of the rhodium contained in the platinum-based alloy of the platinum, the rhodium, and the nickel is within a first range from 2 wt % to 20 wt % inclusive. A second mass percent of the nickel contained in the platinum-based alloy of the platinum, the rhodium, and the nickel is within a second range from 2.5 wt % to 12 wt % inclusive.

BRIEF DESCRIPTION OF THE DRAWINGS

The foregoing and other objects, features, and advantages of the present disclosure will become more apparent from the following detailed description with reference to the accompanying drawings, in which.

Figure 4A:
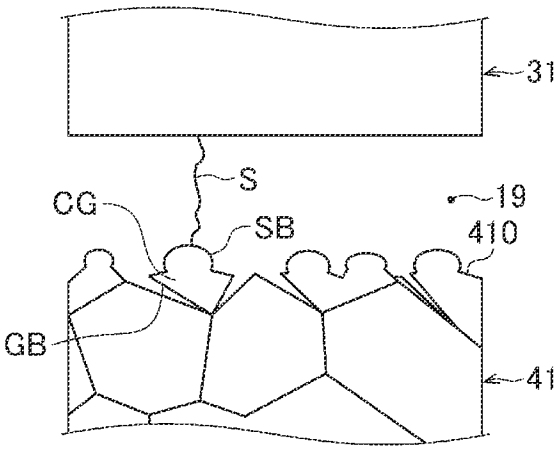
Figure 4B:
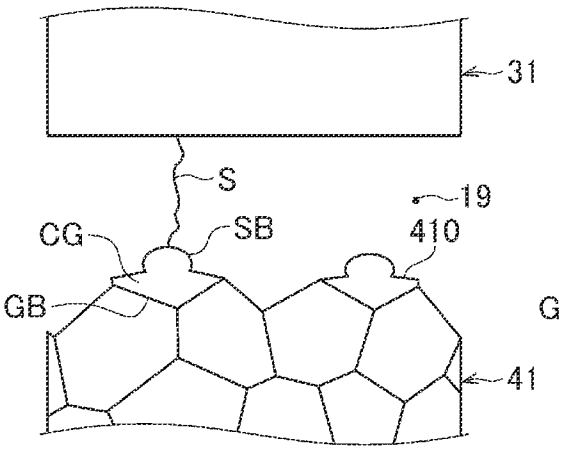
Figure 4C:
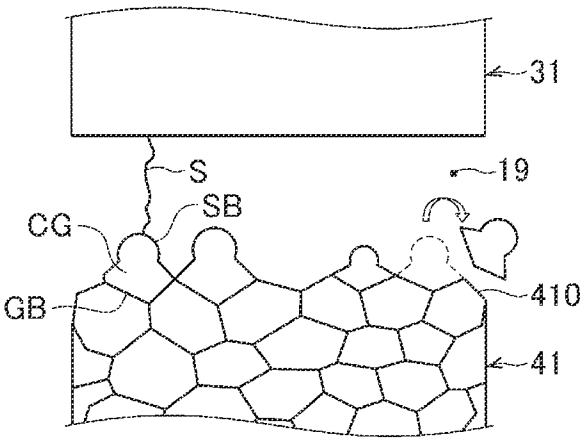
Figure 5:
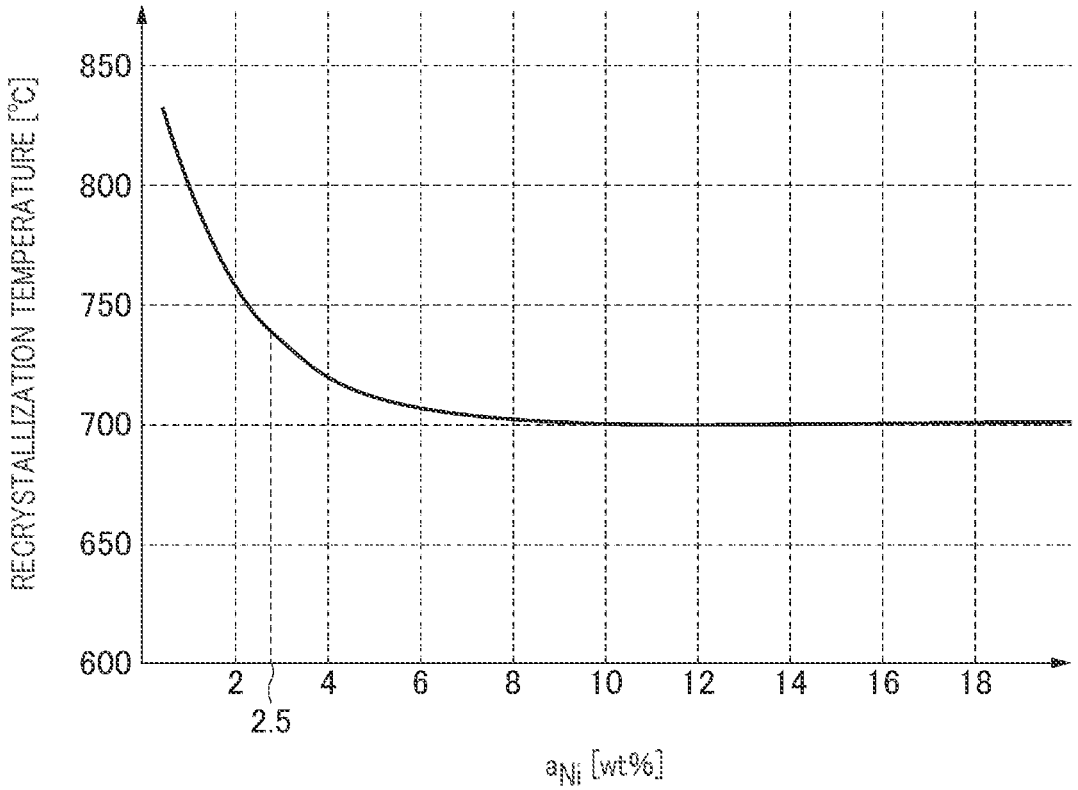
Figure 7:
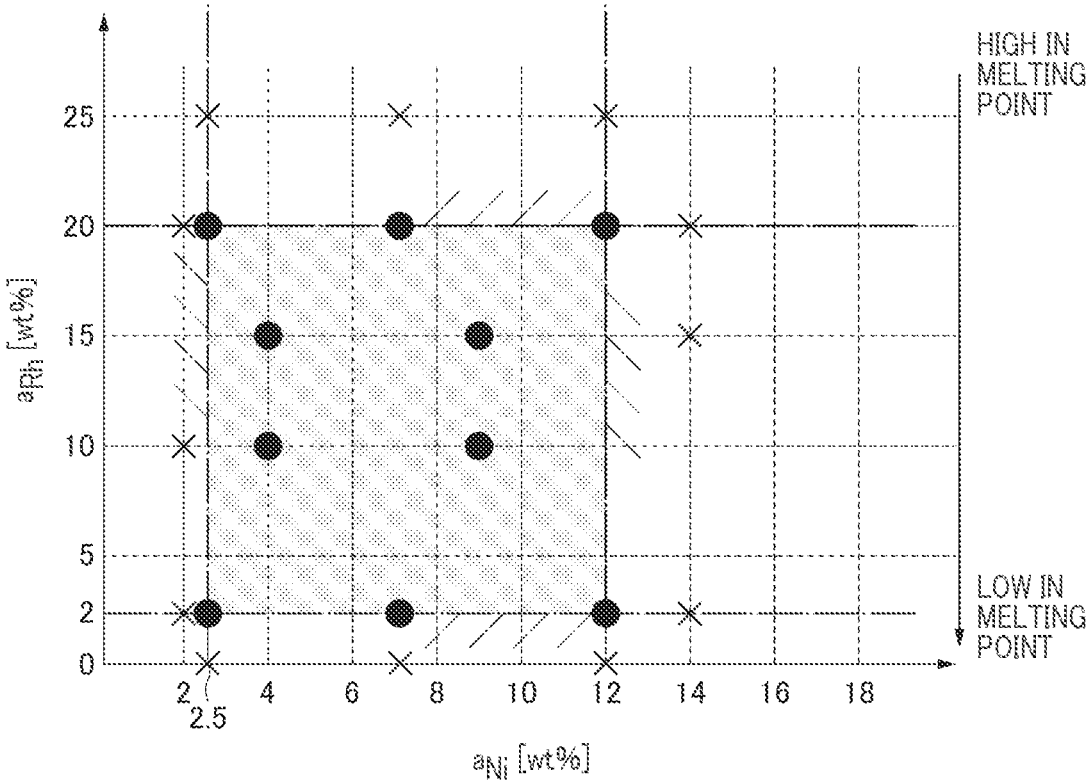
Figure 8:
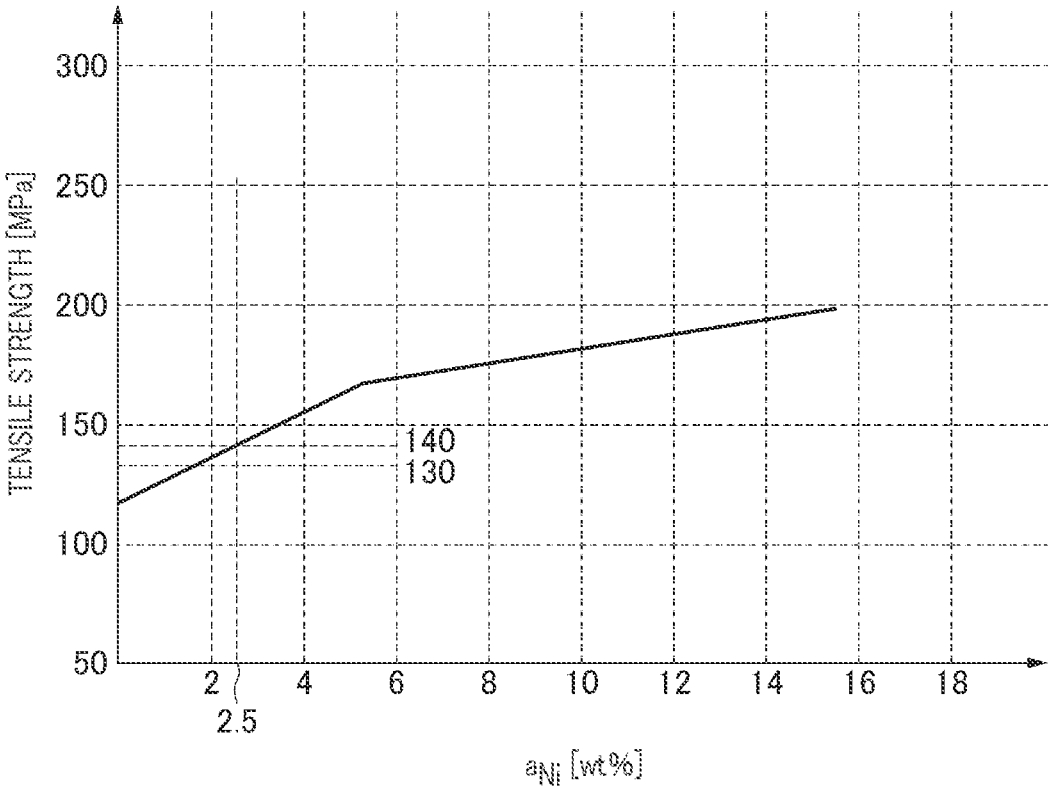
Figure 9:
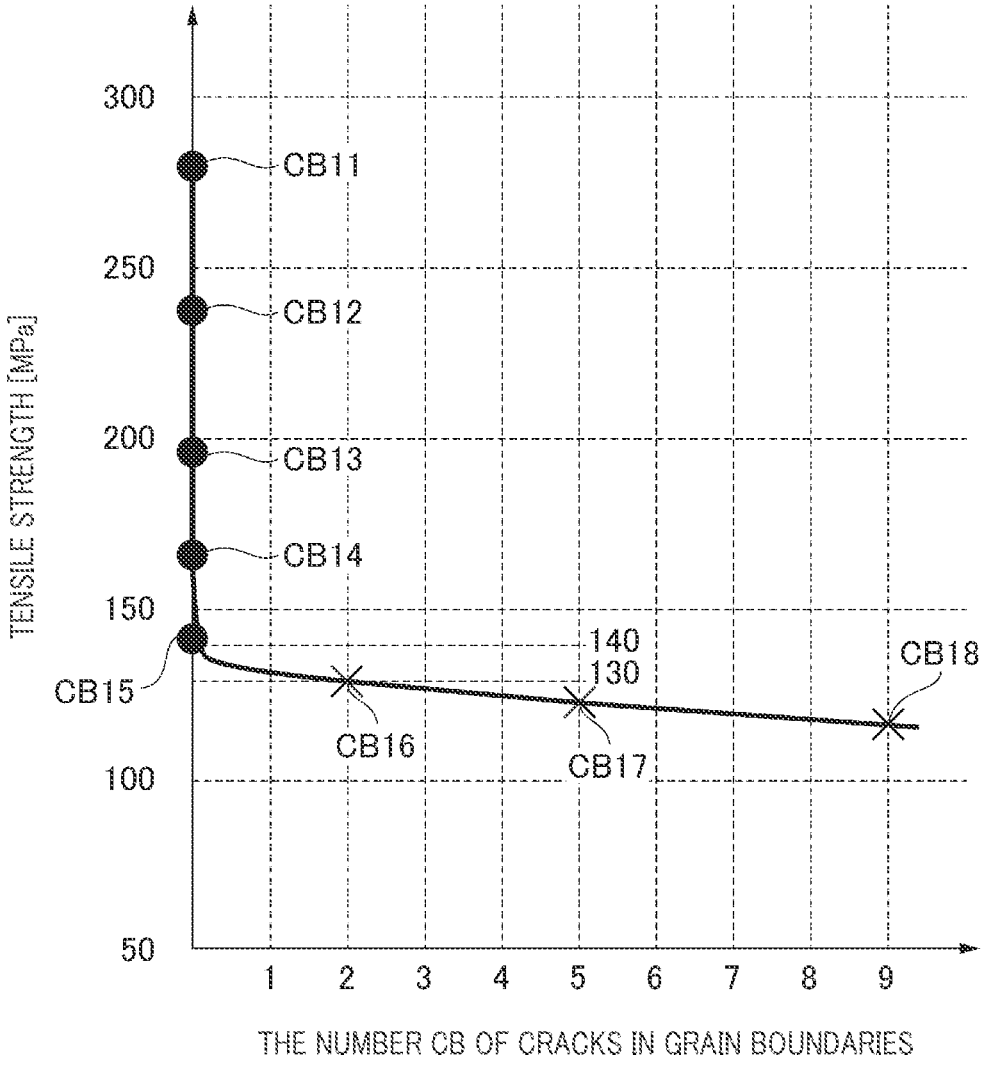

(ii) A second relationship between the example variation of the mass percent of the rhodium (Rh) contained in the alloy of platinum (Pt)-rhodium (Rh)-nickel (Ni) and an example variation of the melting point Tmp of the alloy of platinum (Pt)-rhodium (Rh)-nickel (Ni);

FIGS. 4A to 4C are each a schematic view of how the corresponding discharge portion is wasted;

FIG. 5 is a graph schematically illustrating a relationship between an example variation of a mas percent of the nickel contained in the alloy of platinum (Pt)-rhodium (Rh)-nickel (Ni) and a corresponding example variation of a recrystallization temperature of the alloy of platinum (Pt)-rhodium (Rh)-nickel (Ni);

FIG. 6 is a table illustrating an evaluation result of each sample of the discharge portion;

FIG. 7 is a graph illustrating the plotted evaluation result of each sample of the discharge portion;

FIG. 8 is a graph illustrating an example variation of the tensile strength of the alloy of platinum (Pt)-rhodium (Rh)-nickel (Ni) of the discharge portion measured while the mass percent aNi of the nickel (Ni) in the alloy of platinum (Pt)-rhodium (Rh)-nickel (Ni) varies; and FIG. 9 is a graph illustrating a relationship between an example variation of the number of cracks in grain boundaries of the alloy of platinum (Pt)-rhodium (Rh)-nickel (Ni) of the discharge portion and a corresponding example variation of the tensile strength of the alloy of platinum (Pt)-rhodium (Rh)-nickel (Ni) of the discharge portion.

EMBODIMENTS

Typical spark plugs, one of which is disclosed in Japanese Patent Publication No. 5341752, include a cylindrical insulator extending in a predetermined direction that is an axial direction of the cylindrical insulator, and a metal shell arranged coaxially to surround the cylindrical insulator and having opposing first and second ends in the axial direction. A center electrode of the spark plug is coaxially disposed in the insulator. The center electrode has opposing first and second ends in the axial direction.

A ground electrode of the spark plug is comprised of a ground electrode body extending from the first end of the metal shell. An extending end of the ground electrode body has a discharge surface that faces the first end of the center electrode.

The ground electrode is also comprised of a discharge portion mounted on the discharge surface of the extending end of the ground electrode body. The discharge portion axially protrudes from the discharge surface of the extending end of the ground electrode body toward the first end of the center electrode with a predetermined gap between the discharge surface of a protrusion end of the discharge portion and the first end of the center electrode. The protrusion length of the discharge portion in the axial direction is set to be within the range from 0.4 mm to 1.6 mm inclusive.

The discharge portion is made of a platinum (Pt) alloy that contains platinum as a principal component thereof. The platinum alloy, which has been heated for 50 hours under an atmospheric temperature of 1100° C., has a mean grain diameter (size) of 68 micrometers or less. This prevents deterioration in grain boundary intensity of the platinum alloy under high temperature environments, making it possible to prevent separation of a cracked part of the discharge portion.

To environmentally friendly engines, which have been being developed, application of a high energy ignition system is considered for more reliably igniting the air-fuel mixture; the high energy ignition system is configured to supply higher energy to the discharge portion of the spark plug.

Such a high energy ignition requires extremely high-temperature environments in which the discharge portion lies. Under extremely high-temperature environments, even if the mean grain diameter of the platinum alloy of the discharge portion is set to be lower than 70 micrometers as described in the patent publication, inventors have determined deterioration in grain boundary intensity of the platinum alloy. The deterioration in grain boundary intensity of the platinum alloy of the discharge portion may cause cracks, each of which is generated in a corresponding grain boundary between a corresponding adjacent pair of crystal grains of the platinum alloy. An extension of each crack in the corresponding grain boundary may result in crystal grains, each of which is disposed between a corresponding adjacent pair of the cracks, being separated from the discharge portion, resulting in the discharge portion being likely to waste.

Additionally, under extremely high-temperature environments, partially-exposed grain boundaries, whose ends are exposed on the discharge surface of the discharge portion, may be partially melted and thereafter be resolidified, resulting in so-called sweating grains being generated on the discharge surface of the discharge portion. The sweating grains may be bound with crystal grains in the discharge portion. The diameter of each sweating grain may lie within the range from 10 to 70 μm inclusive, and each sweating grain may be therefore similar to the mean grain diameter of the platinum alloy of the discharge portion included in the spark plug disclosed in the patent publication.

For this reason, an extension of each crack may be likely to induce separation, i.e., drop, of sweating grains, each of which is disposed between a corresponding adjacent pair of the cracks, from the discharge portion of the spark plug, resulting in the discharge portion being more likely to become worn.

From this viewpoint, the present disclosure aims to provide (I) Ground electrodes for a spark plug, each of which is capable of reducing the waste of a discharge portion of the corresponding one of the ground electrodes (II) Spark plugs, each of which is capable of reducing the waste of a discharge portion of a ground electrode of the corresponding one of the spark plugs A first exemplary measure according to the present disclosure provide a ground electrode for a spark plug. The ground electrode includes a ground electrode body arranged to face a center electrode of the spark plug, and a discharge portion mounted on the ground electrode body to face the center electrode with a spark gap between the discharge portion and the center electrode. The discharge portion is made of a platinum-based alloy of platinum, rhodium, and nickel. A first mass percent of the rhodium contained in the platinum-based alloy of the platinum, the rhodium, and the nickel is within a first range from 2 wt % to 20 wt % inclusive. A second mass percent of the nickel contained in the platinum-based alloy of the platinum, the rhodium, and the nickel is within a second range from 2.5 wt % to 12 wt % inclusive.

A second exemplary measure according to the present disclosure provide a spark plug. The spark plug includes a center electrode, and a ground electrode. The ground electrode includes a ground electrode body arranged to face the center electrode of the spark plug, and a discharge portion mounted on the ground electrode body to face the center electrode with a spark gap between the discharge portion and the center electrode. The discharge portion is made of a platinum-based alloy of platinum, rhodium, and nickel. A first mass percent of the rhodium contained in the platinum-based alloy of the platinum, the rhodium, and the nickel is within a first range from 2 wt % to 20 wt % inclusive. A second mass percent of the nickel contained in the platinum-based alloy of the platinum, the rhodium, and the nickel is within a second range from 2.5 wt % to 12 wt % inclusive.

The discharge portion according to each of the first and second exemplary measures is comprised of the alloy of the platinum and the rhodium to which the nickel has been added. This configuration makes it possible to reduce the recrystallization temperature of the alloy of the platinum, the rhodium, and the nickel based on work-hardening of the alloy of the platinum, the rhodium, and the nickel during its manufacture.

A decrease in the recrystallization temperature of the alloy of the platinum, the rhodium, and the nickel increases the grain diameter of the crystal grains of the discharge portion when the discharge portion lies in extremely high-temperature environments to be larger than that of the crystal grains of the discharge portion disclosed in the above patent publication. This reduces the number of grain boundaries in the discharge portion, at least one of which may cause generation of sweating grains, resulting in the sweating grains being less likely to occur on a discharge surface of the discharge portion. This therefore results in the discharge portion being less likely to become warn due to generation of the sweating grains, making it possible to minimize erosion or wear of the discharge portion 41 of the ground electrode 14.

The following describes an exemplary embodiment of the present disclosure with reference to the accompanying drawings. In the exemplary embodiment, descriptions of like parts illustrated in the drawings, to which like reference characters are assigned, are omitted or simplified to avoid redundant description.

The following describes a schematic configuration of a spark plug 10 according to the first embodiment.

Figure 1:
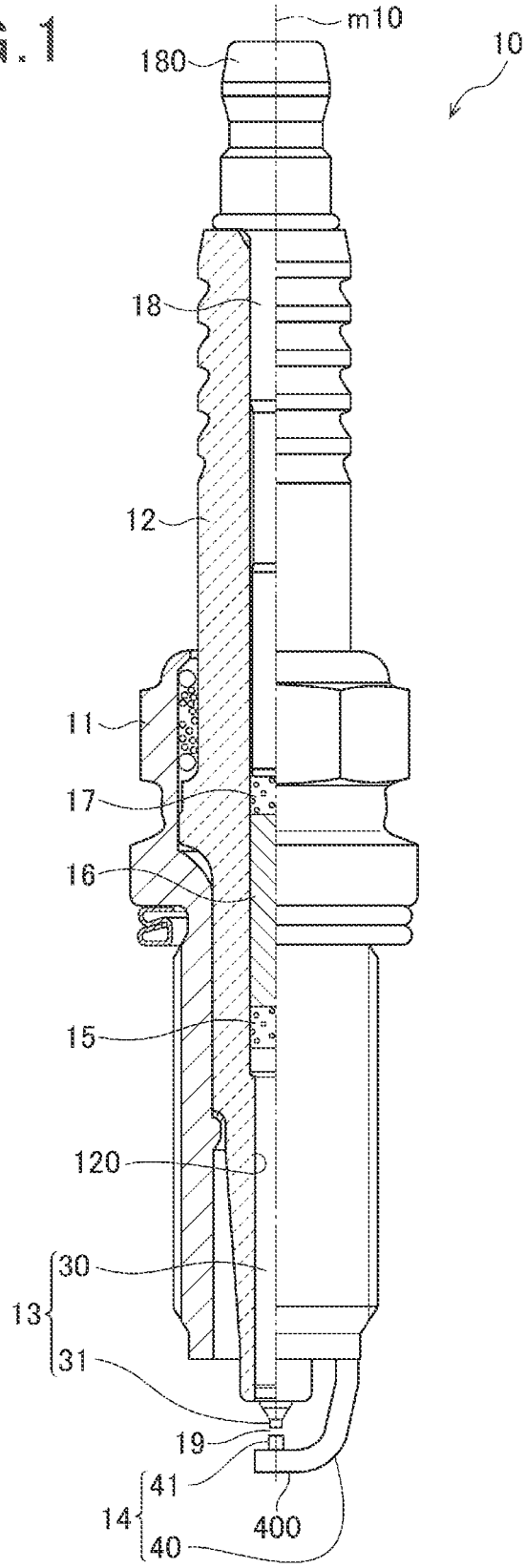
FIG. 1 is a half cross-sectional view of a spark plug according to an exemplary embodiment.

Referring to FIG. 1, the spark plug 10 is for example mounted to an the head of an internal combustion engine, which will be referred to simply as an engine.

The spark plug 10 is configured to ignite, based on a voltage applied thereto, the air-fuel mixture in a corresponding cylinder of the engine.

The spark plug 10, which has a substantially symmetric structure around a center axis m10 thereof, includes a housing 11, an insulator 12, and a center electrode 13, and a ground electrode 14.

The housing 11 has a substantially tubular cylindrical configuration around the center axis m10 of the spark plug 10. The housing 11 is made of a metal material, such as carbon steel.

The insulator 12 has a first portion and a second portion in the center axis m10 of the spark plug 10. The insulator 12 has a first end 12*a* of the first portion, and a second end, i.e., a base end, 12*b* of the second portion. The first portion of the insulator 12, which is located to be lower than the first portion thereof in FIG. 1, is disposed in the housing 11 to be coaxial with the housing 11. The insulator 12, which serves as an insulator according to the exemplary embodiment, is made of an insulating material, such as an alumina material.

That is, the housing 11, which has first end and a second end in the center axis m10 of the spark plug 10, is mounted to the outer periphery of the first portion of the insulator 12 such that the second end of the housing 11 is crimped against the outer periphery of the first portion of the insulator 12, so that the housing 11 and insulator 12 are integrally joined to each other.

The insulator 12 has a through hole 120 formed therethrough from the first end 12*a* to the second end 12*b* thereof: the through hole 120 extends in the center axis m10.

The spark plug 10 includes a first seal member 15, a resistor 16, a second seal member 17, and a terminal fitting 18.

The center electrode 13, the first seal member 15, the resistor 16, the second seal member 17, and the terminal fitting 18 are disposed in the through hole 120 of the insulator 12 in this order from the first end 12*a* to the second end 12*b*.

The center electrode 13, which is disposed in the through hole 120 of the first portion of the insulator 12, is comprised of a center electrode 30 and an electrode chip 31.

The center electrode 30 has a first end and a second end in the center axis m10 of the spark plug 10, and has a substantially columnar shape around the center axis m10 of the spark plug 10. The center electrode 30 is disposed around the center axis m10 of the spark plug 10. The center electrode 13 is made of, for example, a nickel (Ni) alloy, which is highly heat-resistant.

The electrode chip 31 has a substantially columnar shape, and is fixedly mounted to the first end of the center electrode 30. The electrode chip 31 is made of, for example, an iridium (Ir) alloy.

The first seal member 15 is disposed between the center electrode 13 and the resistor 16 to seal a space therebetween.

The terminal fitting 18 has a first end and a second end in the center axis m10 of the spark plug 10, and has a substantially columnar shape around the center axis m10 of the spark plug 10. The terminal fitting 18 is made of, for example, steel. The terminal fitting 18 is comprised of a terminal 180 at its second end. The terminal fitting 18 is disposed in the through hole 120 of the second portion of the insulator 12 while the terminal 180 protrudes from the second end 12*b* of the second portion of the insulator 12.

The second seal member 17 is disposed between the resistor 16 and the first end of the terminal fitting 18 to seal a space therebetween.

The ground electrode 14 is comprised of a ground electrode body 40 and a discharge portion 41. The ground electrode body 40 is made of, for example, a nickel (Ni) alloy. The ground electrode body 40 has a first end 400 and a second end, and the second end of the ground electrode body 40 is mounted to a surface of the first end of the housing 11. The ground electrode body 40 is arranged to curvedly extend from the surface of the first end of the housing 11 such that the first end 400 of the ground electrode body 40 is disposed to face the electrode chip 31 of the center electrode 13.

The discharge portion 41 of the ground electrode 14 is mounted on the first end 400 of the ground electrode body 40 to face the electrode chip 31 of the center electrode 13. The discharge portion 41 is designed as a noble metal chip, i.e., is made of a platinum (Pt)-based alloy, such as an alloy of platinum, rhodium, and nickel, i.e., an alloy of platinum (Pt)-rhodium (Rh)-nickel (Ni).

In particular, the discharge portion 41 is arranged to face the electrode chip 31 of the center electrode 13 with a predetermined gap 19 between the discharge portion 41 and the electrode chip 31. Hereinafter, the predetermined gap 19 between the discharge portion 41 and the electrode chip 31 will be referred to as a spark gap 19.

The electrode 180 of the terminal fitting 18 of the spark plug 10 configured set forth above is electrically connected to an unillustrated external circuit. The external circuit applies a high voltage across the terminal 180 of the terminal fitting 18 and the ground electrode 14 to accordingly generate a discharge spark (see S in FIG. 2) between the electrode chip 31 and the discharge portion 41. The discharge spark S ignites the air-fuel mixture in the corresponding cylinder of the engine to accordingly generate a flame kernel, thus burning the air-fuel mixture.

Figure 2:
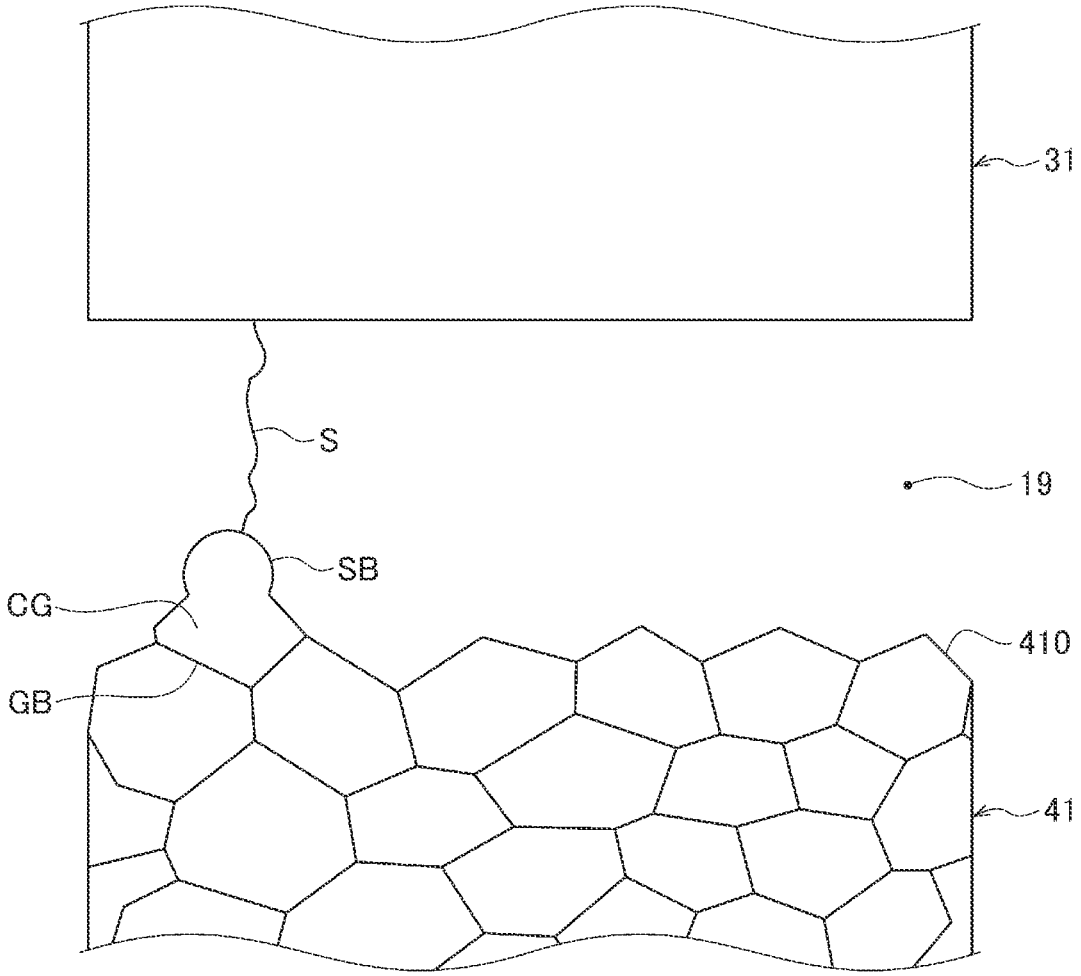
FIG. 2 is a schematic view of an end of a discharge portion of a ground electrode, which faces a center electrode illustrated in FIG. 1.

Let us assume that the discharge portion 41 of the ground electrode 14 is located under extremely high temperature environments. In this assumption, as illustrated in FIG. 2, the intensity of partially-exposed grain boundaries GB, whose ends are exposed on a discharge surface 410 of the discharge portion 41, which faces the electrode chip 31, may decrease. This may result in a crack being generated in each of the partially-exposed grain boundaries GB. This may cause crystal grains CG, each of which is disposed between a corresponding adjacent pair of the cracks, to be more likely separated from the discharge portion 41.

Additionally, the discharge spark S generated between the electrode chip 31 and the discharge surface 410 of the discharge portion 41 causes at least one partially exposed grain boundary GB to be partially melted and thereafter be resolidified, resulting in so-called at least one sweating grain SB being generated on the at least one partially exposed grain boundary GB.

An extension of a crack in the at least one partially exposed grain boundary GB may be likely to induce separation, i.e., drop, of the at least one sweating grain SB from the discharge portion 41, resulting in the discharge portion 41 being more likely to waste.

Hereinafter, the above phenomenon that at least one crack generated in a corresponding at least one grain boundary GB causes separation of at least one sweating grain SB and/or at least one crystal grain CG from the discharge portion 41 will be referred to as a grain-separation phenomenon.

The inventors' experiments have shown that (i) a mode of the grain-separation phenomenon in the discharge portion 41, which represents how the grain-separation phenomenon is generated in the discharge portion 41, and (ii) the amount of erosion of the discharge portion 41 depend on the sizes of the respective crystal grains CG.

Next, the following describes experimental results carried out by the inventors.

First, the inventors performed measurement experimentation of the amount of erosion CA of the discharge portion 41 while changing a mass percent aRh of the rhodium (Rh) in the alloy of platinum (Pt)-rhodium (Rh)-nickel (Ni).

Figure 3A:
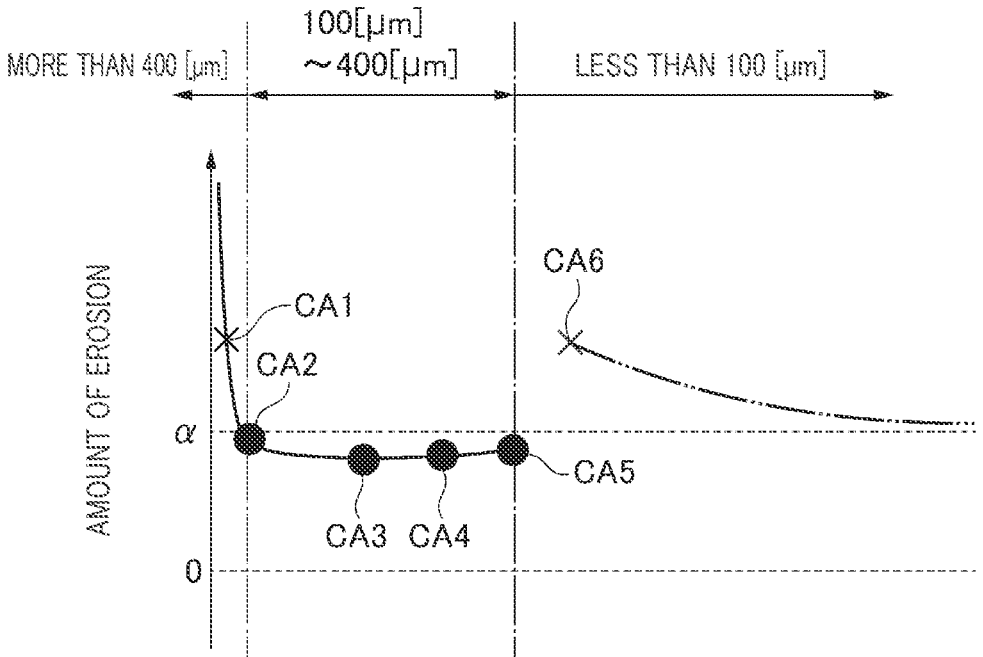
FIG. 3A is a graph illustrating a relationship between an example variation of a mass percent of rhodium (Rh) contained in an alloy of platinum (Pt)-rhodium (Rh)-nickel (Ni) and a corresponding example variation of the amount of erosion of the alloy of platinum (Pt)-rhodium (Rh)-nickel (Ni)
Figure 3B:
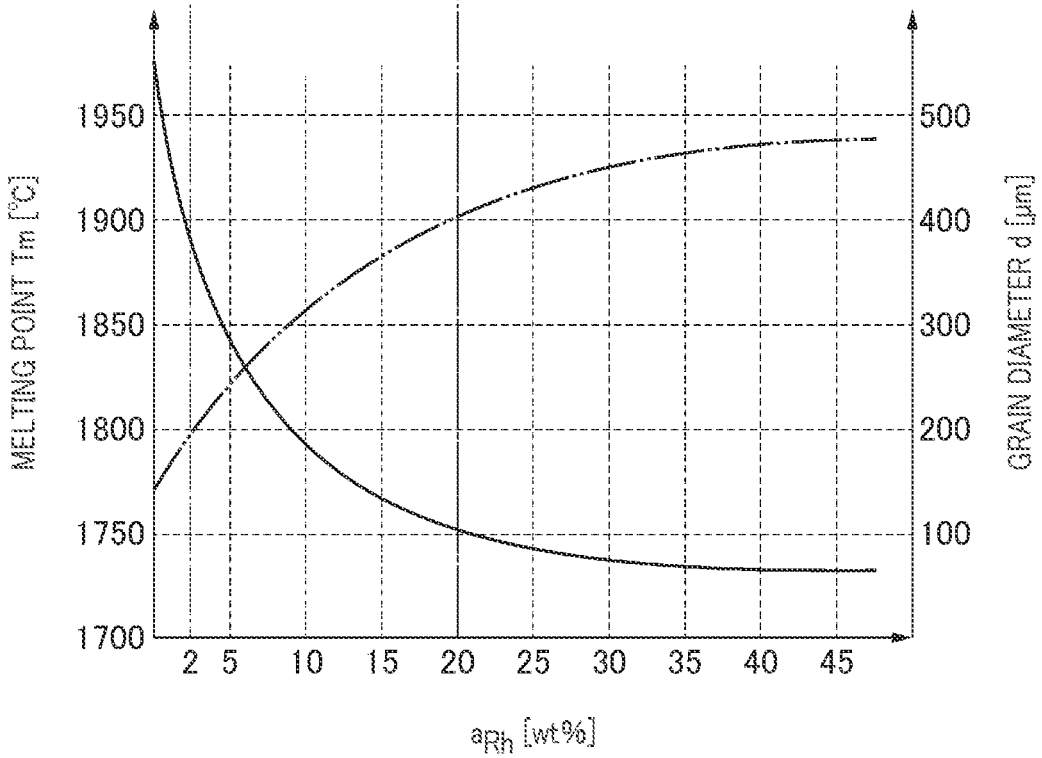
FIG. 3B is a graph schematically illustrating (i) A first relationship between the example variation of the mass percent of the rhodium (Rh) contained in the alloy of platinum (Pt)-rhodium (Rh)-nickel (Ni) and a corresponding example variation of a grain diameter of crystal grains of the alloy of platinum (Pt)-rhodium (Rh)-nickel (Ni)

FIG. 3A illustrates the results of the measurement experimentation, and FIG. 3B illustrates an example of the relationship between (i) An example variation of the mass percent aRh of the rhodium (Rh) in the alloy of platinum (Pt)-rhodium (Rh)-nickel (Ni) and (ii) A corresponding example variation of the grain size, i.e., the grain diameter, d of the crystal grains CG of the alloy of platinum (Pt)-rhodium (Rh)-nickel (Ni) (see a solid curve C1)

FIG. 3B also illustrates an example of the relationship between (i) The example variation of the mass percent aRh of the rhodium (Rh) in the alloy of platinum (Pt)-rhodium (Rh)-nickel (Ni)

(ii) A corresponding example variation of the melting point Tmp of the alloy of platinum (Pt)-rhodium (Rh)-nickel (Ni) (see a chain double-dashed curve C2)

The grain size, i.e., the grain diameter, d of the crystal grains CG of the alloy of platinum (Pt)-rhodium (Rh)-nickel (Ni) represents a mean grain size, i.e., a mean grain diameter, of the crystal grains CG that have been heated for 50 hours under an atmospheric temperature of 1100° C.

The solid curve C1 illustrated in FIG. 3B shows that, the larger the mass percent aRh of the rhodium (Rh) in the alloy of platinum (Pt)-rhodium (Rh)-nickel (Ni), the smaller the grain diameter d of the crystal grains CG of the alloy of platinum (Pt)-rhodium (Rh)-nickel (Ni).

The chain double-dashed curve C2 shows that, the larger the mass percent aRh of the rhodium (Rh) in the alloy of platinum (Pt)-rhodium (Rh)-nickel (Ni), the higher the melting point Tmp of the alloy of platinum (Pt)-rhodium (Rh)-nickel (Ni).

FIG. 3A shows that measured values CA1, CA2, CA3, CA4, CA5, and CA6 of the amount of erosion CA of the discharge portion 41 obtained by the measurement experimentation.

A circular black symbol is assigned to each of the measured values CA2, CA3, CA4, and CA5 which is smaller than or equal to a predetermined threshold amount α. In contrast, a cross symbol is assigned to each of the measured values CA1 and CA6 which is larger than the predetermined threshold amount α.

Comparison between FIGS. 3A and 3B has revealed that, if the mass percent aRh of the rhodium (Rh) in the alloy of platinum (Pt)-rhodium (Rh)-nickel (Ni) satisfies the following expression 2 wt %≤aRh≤20 wt %, that is, the grain diameter d of the crystal grains CG of the alloy of platinum (Pt)-rhodium (Rh)-nickel (Ni) satisfies the following expression 100 μm≤d≤400 μm, the amount of erosion CA of the discharge portion 41 is suppressed to be smaller than or equal to the predetermined threshold amount α.

Comparison between FIGS. 3A and 3B also has revealed that, if the mass percent aRh of the rhodium (Rh) in the alloy of platinum (Pt)-rhodium (Rh)-nickel (Ni) satisfies the following expression aRh<2 wt %, that is, the grain diameter d of the crystal grains CG of the alloy of platinum (Pt)-rhodium (Rh)-nickel (Ni) satisfies the following expression 400 μm<d, the amount of erosion CA of the discharge portion 41 is larger than the predetermined threshold amount α.

Additionally, comparison between FIGS. 3A and 3B also has revealed that, if the mass percent aRh of the rhodium (Rh) in the alloy of platinum (Pt)-rhodium (Rh)-nickel (Ni) satisfies the following expression 20 wt %<aRh, that is, the grain diameter d of the crystal grains CG of the alloy of platinum (Pt)-rhodium (Rh)-nickel (Ni) satisfies the following expression d<100 μm, the amount of erosion CA of the discharge portion 41 is similarly larger than the predetermined threshold amount α.

The inventors have found out at least one reason why the amount of erosion CA of the discharge portion 41 is reduced to be smaller than or equal to the predetermined threshold amount α under the condition that the grain diameter d of the crystal grains CG of the alloy of platinum (Pt)-rhodium (Rh)-nickel (Ni) satisfies the following expression 100 μm≤d≤400 μm.

If the grain diameter d of the crystal grains CG of the alloy of platinum (Pt)-rhodium (Rh)-nickel (Ni) satisfies the expression 400 μm<d, i.e., the crystal grains CG are relatively larger in size, the mass percent aRh of the rhodium (Rh), which has a relatively high melting-point material, in the alloy of platinum (Pt)-rhodium (Rh)-nickel (Ni) is relatively low (see FIG. 3B), resulting in the melting point of the alloy of platinum (Pt)-rhodium (Rh)-nickel (Ni) becoming lower.

This lower melting point of the alloy of platinum (Pt)-rhodium (Rh)-nickel (Ni) facilitates, if discharge sparks are repeatedly generated between the electrode chip 31 and the discharge portion 41, generation of sweating grains SB on the discharge surface 410 of the discharge portion 41.

The generated sweating grains SB are bound with discharge-surface crystal grains COS in the discharge portion 41, which constitute the discharge surface 410 of the discharge portion 41. For this reason, cracks, each of which is generated due to the repeated discharge sparks, in a corresponding partially exposed grain boundary GB between at least one adjacent pair of the discharge-surface crystal grains CGS, facilitate separation of the relatively larger discharge-surface crystal grains CGS bounded with the generated sweating grains SB. This therefore results in a larger quantity of erosion of the discharge portion 41.

If the grain diameter d of the crystal grains CG of the alloy of platinum (Pt)-rhodium (Rh)-nickel (Ni) satisfies the expression d<100 μm, the number of grain boundaries GB, each of which is located between a corresponding pair of the crystal grains CG, increases (see FIG. 4C). This causes the number of crystal grains CG to increase. Additionally, the grain diameter d of the crystal grains CG and a mean grain diameter of the generated sweating grains SB are substantially identical to one another. For this reason, an extension of each crack generated in the corresponding one of the grain boundaries GB facilitates separation of the sweating grains SB from the discharge portion 41, resulting in easier erosion of the discharge portion 41.

In contrast, if the grain diameter d of the crystal grains CG of the alloy of platinum (Pt)-rhodium (Rh)-nickel (Ni) satisfies the expression 100 μm≤d≤400 μm, grain boundaries GB and sweating grains SB are generated as illustrated in FIG. 4B.

That is, the number of grain boundaries GB illustrated in FIG. 4B is smaller than the number of grain boundaries GB illustrated in FIG. 4C, resulting in the number of sweating grains SB illustrated in FIG. 4B being smaller than the number of sweating grains SB illustrated in FIG. 4C. This therefore makes it possible to reduce erosion of the discharge portion 41 illustrated in FIG. 4B due to separation of the sweating grains SB from the discharge portion 41.

As compared with the discharge portion 41 illustrated in FIG. 4A, the discharge portion 41 illustrated in FIG. 4B has a higher value of the mass percent aRh of the rhodium (Rh) in the alloy of platinum (Pt)-rhodium (Rh)-nickel (Ni), resulting in a higher value of the melting point of the alloy of platinum (Pt)-rhodium (Rh)-nickel (Ni). This therefore causes the intensity of each grain boundary GB illustrated in FIG. 4B to be higher, resulting in a crack being less likely to occur in each grain boundary GB illustrated in FIG. 4B. Additionally, the grain diameter d of each crystal grain CG of the discharge portion 41 illustrated in FIG. 4B is smaller than that of the discharge portion 41 illustrated in FIG. 4A. This therefore results in, even if cracks in some grain boundaries GB cause some discharge-surface crystal grains CGS to have been separated from the discharge portion 41 illustrated in FIG. 4B, the amount of erosion of the discharge portion 41 illustrated in FIG. 4B being smaller than that of the discharge portion 41 illustrated in FIG. 4A.

Additionally, if the grain diameter d of the crystal grains CG of the alloy of platinum (Pt)-rhodium (Rh)-nickel (Ni) satisfies the expression 100 μm≤d≤400 μm, each sweating grain SB generated on the discharge surface 410 of the discharge portion 41 has become flattened. This makes it possible to reduce the number of sweating grains SB that become separated from the discharge portion 41 for the case illustrated in FIG. 4B as compared with the number of sweating grains SB that become separated from the discharge portion 41, each of which has a spherical shape.

As described above, the grain diameter d of the crystal grains CG of the alloy of platinum (Pt)-rhodium (Rh)-nickel (Ni) constituting the discharge portion 41, which satisfies the expression 100 μm≤d≤400 μm, suppresses erosion of the discharge portion 41. In other words, the mass percent aRh of the rhodium (Rh) in the alloy of platinum (Pt)-rhodium (Rh)-nickel (Ni) constituting the discharge portion 41, which satisfies the expression 2 wt %≤aRh≤20 wt %, suppresses erosion of the discharge portion 41.

An example variation of a mas percent aNi of the nickel (Ni) in the alloy of platinum (Pt)-rhodium (Rh)-nickel (Ni) has a predetermined relationship with respect to a corresponding example variation of a recrystallization temperature of the alloy of platinum (Pt)-rhodium (Rh)-nickel (Ni); the correlation is illustrated in FIG. 5.

As illustrated in FIG. 5, an increase in the amount of nickel (Ni) added to the alloy of platinum (Pt)-rhodium (Rh) makes it possible to reduce the recrystallization temperature of the alloy of platinum (Pt)-rhodium (Rh)-nickel (Ni) based on work-hardening of the alloy of platinum (Pt)-rhodium (Rh)-nickel (Ni) during its manufacture. A decrease in the recrystallization temperature of the alloy of platinum (Pt)-rhodium (Rh)-nickel (Ni) increases the grain diameter of high-temperature crystal grains generated when the discharge portion 41 of the ground electrode 14 lies in extremely high-temperature environments. For example, a decrease in the recrystallization temperature of the alloy of platinum (Pt)-rhodium (Rh)-nickel (Ni) increases the grain diameter of the high-temperature crystal grains to be larger than that of the conventional spark plug disclosed in the above patent publication, such as larger than or equal to 100 μm.

The inventors performed measurement experimentation of (i) high-temperature characteristics of the discharge portion 41 and (ii) durability characteristics of the engine to which the spark plug 10 is mounted while changing the mass percent aNi of the nickel (Ni) in the alloy of platinum (Pt)-rhodium (Rh)-nickel (Ni) with the mass percent aRh of the rhodium (Rh) in the alloy of platinum (Pt)-rhodium (Rh)-nickel (Ni) being kept within the range between 0 wt % and 25 wt % inclusive.

FIG. 6 illustrates the results of the measurement experiment.

Specifically, the inventors prepared 22 samples 1 to 22 of the discharge portion 41 of the ground electrode 14. The alloy of platinum (Pt)-rhodium (Rh)-nickel (Ni) of each of the samples 1 to 22 has a selected one of different mass-percent patterns of platinum (Pt), rhodium (Rh), and nickel (Ni) (see FIG. 6).

For example, the mass-percent pattern of platinum (Pt), rhodium (Rh), and nickel (Ni) of the discharge portion of the sample 1 is set to 98 wt % of platinum (Pt), 2 wt % of rhodium (Rh), and 2 wt % of nickel (Ni). As another example, the mass-percent pattern of platinum (Pt), rhodium (Rh), and nickel (Ni) of the discharge portion 41 of the sample 4 is set to 98 wt % of platinum (Pt), 0 wt % of rhodium (Rh), and 2 wt % of nickel (Ni). As a further example, the mass-percent pattern of platinum (Pt), rhodium (Rh), and nickel (Ni) of the discharge portion 41 of the sample 15 is set to 76 wt % of platinum (Pt), 15 wt %/o of rhodium (Rh), and 9 wt % of nickel (Ni).

Referring to FIG. 6, the measurement experiment used, as first and second evaluation indicators of high-temperature characteristics for each sample 1 to 22, a high-temperature strength evaluation indicator and a grain-diameter evaluation indicator.

The high-temperature strength evaluation indicator represents the tensile strength of the alloy of platinum (Pt)-rhodium (Rh)-nickel (Ni) of each sample 1 to 22 after the corresponding sample has been exposed to the temperature of 1000° C. for 50 hours. The grain-diameter evaluation indicator represents that the grain diameter, i.e., the mean grain diameter, of the crystal grains CG of the alloy of platinum (Pt)-rhodium (Rh)-nickel (Ni) of each sample 1 to 22 that has been heated for 50 hours under an atmospheric temperature of 1100° C.

Specifically, if a value of the high-temperature strength evaluation indicator of any of the samples 1 to 22 is higher than or equal to 140 MPa, a circular symbol is assigned to the corresponding sample, which shows a good evaluation result.

Otherwise, if a value of the high-temperature strength evaluation indicator of any of the samples 1 to 22 is lower than 140 MPa, a cross symbol is assigned to the corresponding sample, which shows a bad evaluation result.

Additionally, if a value of the grain-diameter evaluation indicator of any of the samples 1 to 22 is higher than or equal to 1000 μm, a circular symbol is assigned to the corresponding sample, which shows a good evaluation result.

Otherwise, if a value of the grain-diameter evaluation indicator of any of the samples 1 to 22 is lower than 1000 μm, a cross symbol is assigned to the corresponding sample, which shows a bad evaluation result.

Referring to FIG. 6, the measurement experiment used the following third to fifth evaluation indicators representing the durability characteristics of a four-cylinder 2000-cc DOHC engine, to which the spark plug 10 of each sample 1 to 22 is mounted, after the four-cylinder DOHC engine has operated for 180 hours at full load; DOHC stands for Double Overhead Camshaft.

The third evaluation indicator is a sweating-grain evaluation indicator representing whether one or more sweating grains are generated in each sample 1 to 22.

The fourth evaluation indicator is a crack evaluation indicator representing whether a crack is generated in at least one grain boundary GB in each sample 1 to 22.

The fifth evaluation indicator is an erosion-resistant, i.e., a wear-resistant, indicator representing whether the spark gap 19 of each sample 1 to 22 has expanded by 0.2 mm or less before and after the full-road operation of the four-cylinder DOHC engine for 180 hours.

Specifically, if the sweating-grain evaluation indicator of any of the samples 1 to 22 represents that no sweating grains are generated in the corresponding sample, a circular symbol is assigned to the corresponding sample, which shows a good evaluation result.

Otherwise, if the sweating-grain evaluation indicator of any of the samples 1 to 22 represents that one or more sweating grains are generated in the corresponding sample, a cross symbol is assigned to the corresponding sample, which shows a bad evaluation result.

Similarly, if the crack evaluation indicator of any of the samples 1 to 22 represents that a crack is generated in any grain boundary GB in the corresponding sample, a circular symbol is assigned to the corresponding sample, which shows a good evaluation result.

Otherwise, if the crack evaluation indicator of any of the samples 1 to 22 represents that a crack is generated in at least one grain boundary GB in the corresponding sample, a cross symbol is assigned to the corresponding sample, which shows a bad evaluation result.

Additionally, if the erosion-resistant indicator of any of the samples 1 to 22 represents that the spark gap 19 of each sample 1 to 22 has expanded by 0.2 mm or less before and after the full-road operation of the four-cylinder DOHC engine for 180 hours, a circular symbol is assigned to the corresponding sample, which shows a good evaluation result.

Otherwise, if the erosion-resistant indicator of any of the samples 1 to 22 represents that the spark gap 19 of each sample 1 to 22 has expanded by more than 0.2 mm before and after the full-road operation of the four-cylinder DOHC engine for 180 hours, a cross symbol is assigned to the corresponding sample, which shows a bad evaluation result.

To sum up, FIG. 6 illustrates an evaluation result of each sample 1 to 22 of the discharge portion 41 obtained by the measurement experiment.

Specifically, FIG. 6 illustrates that the crack evaluation indicator of each of the samples 1 to 3, whose mass percent aNi of the nickel (Ni) in the alloy of platinum (Pt)-rhodium (Rh)-nickel (Ni) is less than 2.5 wt %, shows the cross symbol, i.e., the bad evaluation result. That is, the samples 1 to 3 are each determined as the bad evaluation result, because an expansion of a crack generated in at least one grain boundary GB may cause a grain-separation phenomenon in the corresponding sample.

FIG. 6 illustrates that (1) The high-temperature strength evaluation indicator of each of the samples 4 to 22, whose mass percent aNi of the nickel (Ni) in the alloy of platinum (Pt)-rhodium (Rh)-nickel (Ni) is within the range from 2.5 wt %/o to 14 wt % inclusive, shows the circular symbol, i.e., the good evaluation result (2) The crack evaluation indicator of each of the samples 20 to 22, whose mass percent aNi of the nickel (Ni) in the alloy of platinum (Pt)-rhodium (Rh)-nickel (Ni) is more than 12 wt %, shows the cross symbol, i.e., the bad evaluation result (3) The erosion-resistant indicator of each of the samples 20 to 22, whose mass percent aNi of the nickel (Ni) in the alloy of platinum (Pt)-rhodium (Rh)-nickel (Ni) is more than 12 wt %, shows the cross symbol, i.e., the bad evaluation result That is, the samples 4 to 19 are each determined as a good evaluation result, because the occurrence of a crack in at least one grain boundary GB is prevented to accordingly suppress erosion of the corresponding discharge portion 41 due to a grain-separation phenomenon.

In contrast, the samples 20 to 22 are each determined as a bad evaluation result. The inventors estimate that a factor of the occurrence of these bad samples 20 to 22 is that nickel oxide is generated adjacent to the at least one grain boundary GB so that the intensity of the at least one grain boundary GB is reduced.

In FIG. 6, the inventors focus each of the samples 4, 10, and 16, whose (i) mass percent aNi of the nickel (Ni) in the alloy of platinum (Pt)-rhodium (Rh)-nickel (Ni) is within the range from 2.5 wt % to 12 wt % inclusive, and (ii) mass percent aRh of the rhodium (Rh) in the alloy of platinum (Pt)-rhodium (Rh)-nickel (Ni) is less than 2.0 wt %.

Specifically, the sweating-grain evaluation indicator of each of the samples 4, 10, and 16 shows the cross symbol, i.e., the bad evaluation result, and similarly the erosion-resistant indicator of each of the samples 4, 10, and 16 shows the cross symbol, i.e., the bad evaluation result.

The inventors estimate that a factor of the occurrence of each bad sample 4, 10, 16 is that sweating grains SB as illustrated in FIG. 4A are generated in the discharge portion 41 of the corresponding sample. That is, the melting point of the alloy of platinum (Pt)-rhodium (Rh)-nickel (Ni) of the discharge portion 41 of each sample 4, 10, 16 becomes lower due to a shortage of the content amount of the rhodium (Rh), which is high-melting material, in the alloy of platinum (Pt)-rhodium (Rh)-nickel (Ni), resulting in the number of sweating grains SB generated being larger. This therefore results in erosion of the discharge portion 41 of each sample 4, 10, 16 due to the generated sweating grains SB as illustrated in FIG. 4A.

In FIG. 6, the inventors focus each of the samples 7, 13, and 19, whose (i) mass percent aNi of the nickel (Ni) in the alloy of platinum (Pt)-rhodium (Rh)-nickel (Ni) is within the range from 2.5 wt % to 12 wt % inclusive, and (ii) mass percent aRh of the rhodium (Rh) in the alloy of platinum (Pt)-rhodium (Rh)-nickel (Ni) is 25 wt %.

Specifically, the sweating-grain evaluation indicator, the crack evaluation indicator, and the erosion-resistant indicator of each of the samples 7, 13, and 19 show the cross symbol, i.e., the bad evaluation result.

The inventors estimate that a factor of the occurrence of each bad sample 7, 13, 19 is that the crystal grains CG as illustrated in FIG. 4C are generated in the discharge portion 41 of the corresponding sample. That is, the grain diameter d of the crystal grains CG of the alloy of platinum (Pt)-rhodium (Rh)-nickel (Ni) satisfies the expression $d<100$ μm, that is, the grain diameter d of the crystal grains CG and the mean grain diameter of the generated sweating grains SB are substantially identical to one another, resulting in erosion of the discharge portion 41 of the corresponding sample due to separation of the sweating grains SB from the discharge portion 41.

In FIG. 6, the inventors focus each of the samples 5, 6, 8, 9, 11, 12, 14, 15, 17, and 18, whose (i) mass percent aNi of the nickel (Ni) in the alloy of platinum (Pt)-rhodium (Rh)-nickel (Ni) is within the range from 2.5 wt % to 12 wt % inclusive, and (ii) mass percent aRh of the rhodium (Rh) in the alloy of platinum (Pt)-rhodium (Rh)-nickel (Ni) is within the range from 2.0 wt % to 20 wt % inclusive.

Specifically, all the first to fifth evaluation indicators of each of the samples 5, 6, 8, 9, 11, 12, 14, 15, 17, and 18 show the circular symbol, i.e., the good evaluation result.

The inventors estimate that a factor of the occurrence of each good sample 5, 6, 8, 9, 11, 12, 14, 15, 17, 18 is that the crystal grains CG as illustrated in FIG. 4B are generated in the discharge portion 41 of the corresponding sample. That is, the grain diameter d of the crystal grains CG of the alloy of platinum (Pt)-rhodium (Rh)-nickel (Ni) satisfies the expression $100\ \mu m \leq d \leq 400\ \mu m$, and the intensity of each grain boundary GB of the alloy of platinum (Pt)-rhodium (Rh)-nickel (Ni) is kept high. This prevents erosion of the discharge portion 41 of the corresponding sample due to separation of sweating grains SB from the discharge portion 41.

FIG. 7 illustrates a graph that has the horizontal axis showing the mass percent aNi of the nickel (Ni) in the alloy of platinum (Pt)-rhodium (Rh)-nickel (Ni), and the vertical axis showing the mass percent aRh of the rhodium (Rh) in the alloy of platinum (Pt)-rhodium (Rh)-nickel (Ni). On the graph, the evaluation results of the respective samples 1 to 22 are plotted. Specifically, circular black symbols are respectively assigned to selected samples whose first to fifth evaluation indicators respectively show the good evaluation results, and cross symbols are respectively assigned to the remaining samples, at least one of the first to fifth evaluation indicators of which shows the poor evaluation.

FIG. 7 shows that any samples whose first to fifth evaluation indicators are all the good evaluation results are located in a region, which is hatched in FIG. 7, on the graph; the region is defined such that (i) The mass percent aRh of the rhodium (Rh) in the alloy of platinum (Pt)-rhodium (Rh)-nickel (Ni) satisfies the expression 2 wt %≤aRh≤20 wt %

(ii) The mass percent aNi of the nickel (Ni) in the alloy of platinum (Pt)-rhodium (Rh)-nickel (Ni) satisfies the expression 2.5 wt %≤aRh≤12 wt %

That is, respectively setting both the mass percent aRh of the rhodium (Rh) and the mass percent aNi of the nickel (Ni) in the alloy of platinum (Pt)-rhodium (Rh)-nickel (Ni) to any values whose intersect coordinate position lies in the hatched region enables all the first to fifth evaluation indicators to respectively become the good evaluation results.

FIG. 8 is a graph representing an example variation of the tensile strength of the alloy of platinum (Pt)-rhodium (Rh)-nickel (Ni) of the discharge portion 41 measured while the mass percent aNi of the nickel (Ni) in the alloy of platinum (Pt)-rhodium (Rh)-nickel (Ni) varies.

FIG. 9 is a graph representing (1) the number of cracks in the grain boundaries GB of the alloy of platinum (Pt)-rhodium (Rh)-nickel (Ni) of the discharge portion 41 of a first sample CB11 in comparison with a corresponding value of the tensile strength of the alloy of platinum (Pt)-rhodium (Rh)-nickel (Ni) of the discharge portion 41 of the first sample CB11; (2) the number of cracks in the grain boundaries GB of the alloy of platinum (Pt)-rhodium (Rh)-nickel (Ni) of the discharge portion 41 of a second sample CB12 in comparison with a corresponding value of the tensile strength of the alloy of platinum (Pt)-rhodium (Rh)-nickel (Ni) of the discharge portion 41 of the second sample CB12, . . . , and (8) the number of cracks in the grain boundaries GB of the alloy of platinum (Pt)-rhodium (Rh)-nickel (Ni) of the discharge portion 41 of an eight sample CB18 in comparison with a corresponding value of the tensile strength of the alloy of platinum (Pt)-rhodium (Rh)-nickel (Ni) of the discharge portion 41 of the eight sample CB18.

In FIG. 9, circular black symbols are respectively assigned to the samples CB11 to Cb15, each of which has the number of cracks of 0, and cross symbols are respectively assigned to the remaining samples CB16 to CB 18, each of which has the number of cracks being 1 or more.

FIG. 9 shows that, if the alloy of platinum (Pt)-rhodium (Rh)-nickel (Ni) of the discharge portion 41 of the ground electrode 14 has the tensile strength of 140 MPa or more, the number of cracks of 0 in the grain boundaries GB of the alloy of platinum (Pt)-rhodium (Rh)-nickel (Ni) of the discharge portion 41.

FIG. 8 shows that, if the mass percent aNi of the nickel (Ni) in the alloy of platinum (Pt)-rhodium (Rh)-nickel (Ni) of the discharge portion 41 of the ground electrode 14 satisfies the expression 2.5 wt % aNi, the tensile strength of the discharge portion 41 of the ground electrode 14 becomes higher than or equal to 140 MPa.

The mass percent aNi of the nickel (Ni) in the alloy of platinum (Pt)-rhodium (Rh)-nickel (Ni) of the discharge portion 41 of the ground electrode 14, which satisfies the expression 2.5 wt % s aNi, results in cracks in the grain boundaries GB of the alloy of platinum (Pt)-rhodium (Rh)-nickel (Ni) of the discharge portion 41 being less likely to occur, making it possible to minimize erosion or wear of the discharge portion 41 of the ground electrode 14.

The spark plug 10 and the ground electrode 14 of the spark plug 10 according to the exemplary embodiment achieves the following first to third advantageous benefits.

The first advantageous benefit is as follows:

The discharge portion 41 of the ground electrode 14 is made of a platinum (Pt)-based alloy, such as an alloy of platinum (Pt)-rhodium (Rh)-nickel (Ni). The alloy of platinum (Pt)-rhodium (Rh)-nickel (Ni) contains (i) rhodium (Rh) whose mass percent lies within the range from 2 wt % to 20 wt % inclusive, and (ii) nickel (Ni) whose mass percent lies within the range from 2.5 wt % to 12 wt % inclusive.

That is, the discharge portion 41 is comprised of the alloy of platinum (Pt)-rhodium (Rh) to which nickel (Ni) has been added. This configuration makes it possible to reduce the recrystallization temperature of the alloy of platinum (Pt)-rhodium (Rh)-nickel (Ni) based on work-hardening of the alloy of platinum (Pt)-rhodium (Rh)-nickel (Ni) during its manufacture.

A decrease in the recrystallization temperature of the alloy of platinum (Pt)-rhodium (Rh)-nickel (Ni) increases the grain diameter of the crystal grains CG of the discharge portion 41 when the discharge portion 41 lies in extremely high-temperature environments to be larger than that of the crystal grains of the discharge portion disclosed in the above patent publication. This reduces the number of grain boundaries GB in the discharge portion 41, at least one of which may cause generation of sweating grains SB, resulting in the sweating grains SB being less likely to occur on the discharge surface 410 of the discharge portion 41. This therefore results in the discharge portion 41 being less likely to wear due to generation of the sweating grains SB, making it possible to minimize erosion or wear of the discharge portion 41 of the ground electrode 14.

The above configuration of the discharge portion 41 of the grand electrode 14 enables, even if there are some sweating grains SB on the discharge surface 410 of the discharge portion 41, each of the sweating grains SB to become flattered. This makes it possible to reduce the number of sweating grains SB that become separated from the discharge portion 41 as compared with the number of sweating grains from the discharge portion 41, each of which has a spherical shape.

The above configuration of the discharge portion 41 of the grand electrode 14 increases the intensity of each grain boundary GB in a corresponding adjacent pair of the crystal grains CG, i.e., recrystallized grains, in the discharge portion 41, preventing separation of at least one adjacent pair of the crystal grains CG through a corresponding at least one grain boundary GB from the discharge portion 41.

The second advantageous benefit is as follows:

The mean grain diameter of the crystal grains CG of the alloy of platinum (Pt)-rhodium (Rh)-nickel (Ni), which have been heated for 50 hours under an atmospheric temperature of 1100° C., is set to be greater than or equal to 100 μm and less than or equal to 400 μm.

This configuration makes it possible to reduce, as illustrated in FIG. 7A, the amount of erosion of the discharge portion 41 to be smaller than the predetermined threshold amount a.

The third advantageous benefit is as follows:

The tensile strength of the alloy of platinum (Pt)-rhodium (Rh)-nickel (Ni) of the discharge portion 41 after the alloy of platinum (Pt)-rhodium (Rh)-nickel (Ni) of the discharge portion 41 has been exposed to the temperature of 1000° C. for 50 hours has a predetermined characteristic that is higher than or equal to 140 MPa.

This configuration results in, as illustrated in FIGS. 8 and 9, cracks in the grain boundaries GB of the alloy of platinum (Pt)-rhodium (Rh)-nickel (Ni) of the discharge portion 41 being less likely to occur, making it possible to minimize erosion or wear of the discharge portion 41 of the ground electrode 14.

The above exemplary embodiment can be modified as follows:

Specifically, the configuration of the spark plug 10 can be freely modified.

The present disclosure has been described in accordance with the above embodiment, but should not be construed as being limited to the exemplary embodiment.

Various modifications, each of which is based on the exemplary embodiment to which a skilled-person's design change has been added, can be included within the scope of the present disclosure as long as each of the various modifications includes the features of the present disclosure. The arrangement, conditions, and shape of each component disclosed in the above exemplary embodiment are not limited to those of the corresponding component according to the present disclosure, and therefore are freely changed. The present disclosure can include various combinations of components described in the exemplary embodiment as long as there is no contradiction in each of the combinations.

What is claimed is:

1. A ground electrode for a spark plug, the ground electrode comprising:

a ground electrode body arranged to face a center electrode of the spark plug; and a discharge portion mounted on the ground electrode body to face the center electrode with a spark gap between the discharge portion and the center electrode, the discharge portion being made of a platinum-based alloy of platinum, rhodium, and nickel, a first mass percent of the rhodium contained in the platinum-based alloy of the platinum, the rhodium, and the nickel being within a first range from 2 wt % to 20 wt % inclusive, a second mass percent of the nickel contained in the platinum-based alloy of the platinum, the rhodium, and the nickel being within a second range from 2.5 wt % to 12 wt % inclusive, wherein:

the platinum-based alloy of the platinum, the rhodium, and the nickel, which has been heated for 50 hours under an atmospheric temperature of 1100° C., has a mean grain diameter that is greater than or equal to 100 μm and less than or equal to 400 μm.

2. A ground electrode for a spark plug, the ground electrode comprising:

a ground electrode body arranged to face a center electrode of the spark plug; and a discharge portion mounted on the ground electrode body to face the center electrode with a spark gap between the discharge portion and the center electrode, the discharge portion being made of a platinum-based alloy of platinum, rhodium, and nickel, a first mass percent of the rhodium contained in the platinum-based alloy of the platinum, the rhodium, and the nickel being within a first range from 2 wt % to 20 wt % inclusive, a second mass percent of the nickel contained in the platinum-based alloy of the platinum, the rhodium, and the nickel being within a second range from 2.5 wt % to 12 wt % inclusive, wherein:

the platinum-based alloy of the platinum, the rhodium, and the nickel, which has been exposed to 1000° C. for 50 hours, has a tensile strength that is higher than or equal to 140 MPa.

3. A sparkplug comprising:

a center electrode; and a ground electrode, the ground electrode comprising:

a ground electrode body arranged to face the center electrode of the spark plug; and a discharge portion mounted on the ground electrode body to face the center electrode with a spark gap between the discharge portion and the center electrode, the discharge portion being made of a platinum-based alloy of platinum, rhodium, and nickel, a first mass percent of the rhodium contained in the platinum-based alloy of the platinum, the rhodium, and the nickel being within a first range from 2 wt % to 20 wt % inclusive, a second mass percent of the nickel contained in the platinum-based alloy of the platinum, the rhodium, and the nickel being within a second range from 2.5 wt % to 12 wt % inclusive, wherein:

the platinum-based alloy of the platinum, the rhodium, and the nickel, which has been heated for 50 hours under an atmospheric temperature of 1100° C., has a mean grain diameter that is greater than or equal to 100 μm and less than or equal to 400 μm.

4. A spark plug comprising:

a center electrode; and a ground electrode, the ground electrode comprising:

a ground electrode body arranged to face the center electrode of the spark plug; and a discharge portion mounted on the ground electrode body to face the center electrode with a spark gap between the discharge portion and the center electrode, the discharge portion being made of a platinum-based alloy of platinum, rhodium, and nickel, a first mass percent of the rhodium contained in the platinum-based alloy of the platinum, the rhodium, and the nickel being within a first range from 2 wt % to 20 wt % inclusive, a second mass percent of the nickel contained in the platinum-based alloy of the platinum, the rhodium, and the nickel being within a second range from 2.5 wt % to 12 wt % inclusive, wherein:

the platinum-based alloy of the platinum, the rhodium, and the nickel, which has been exposed to 1000° C. for 50 hours, has a tensile strength that is higher than or equal to 140 MPa.

* * * * *